US006524682B1

(12) United States Patent
Leavell

(10) Patent No.: US 6,524,682 B1
(45) Date of Patent: Feb. 25, 2003

(54) GLASS BACKDUST FOR ROOF COVERING

(75) Inventor: Daniel N. Leavell, Granville, OH (US)

(73) Assignee: Owens-Corning Fiberglas Technology, Inc., Summit, IL (US)

( * ) Notice: Subject to any disclaimer, the term of this patent is extended or adjusted under 35 U.S.C. 154(b) by 185 days.

(21) Appl. No.: 09/703,567

(22) Filed: Nov. 1, 2000

(51) Int. Cl.[7] ..... B32B 5/16

(52) U.S. Cl. ..... 428/143; 428/143; 428/149; 427/187; 427/186

(58) Field of Search ..... 428/143, 149; 427/187, 186

(56) References Cited

U.S. PATENT DOCUMENTS

| | | | | |
|---|---|---|---|---|
| 4,064,112 A | * | 12/1977 | Rothe et al. | 528/272 |
| 4,241,107 A | | 12/1980 | Mandish et al. | |
| 4,795,661 A | | 1/1989 | Bondoc et al. | |
| 4,960,616 A | | 10/1990 | Magnani | |
| 5,206,068 A | | 4/1993 | Kalkanoglu | |
| 5,380,552 A | | 1/1995 | George et al. | |
| 5,382,449 A | | 1/1995 | Hedges | |
| 5,516,573 A | | 5/1996 | George et al. | |
| 5,964,911 A | | 10/1999 | Morano et al. | |
| 5,981,413 A | | 11/1999 | Hale | |
| 6,057,257 A | | 5/2000 | Morano et al. | |

FOREIGN PATENT DOCUMENTS

CA 2284071 9/1999

OTHER PUBLICATIONS

Dated Oct. 4, 2000—Minpro International Ltd. Solutions for the Mineral Processing, Waste Treatment and Recycling Industries.

* cited by examiner

*Primary Examiner*—William P. Watkins, III
(74) *Attorney, Agent, or Firm*—Inger H. Eckert; James J. Dottavio

(57) ABSTRACT

A roof covering has a back surface and a plurality of glass particles applied as a backdust on the back surface. A method of manufacturing a roof covering includes coating a substrate with an organic-based coating material, and applying a plurality of glass particles as a backdust on the back surface of the coated substrate.

20 Claims, 4 Drawing Sheets

GLASS BACKDUST FOR ROOF COVERING

TECHNICAL FIELD AND INDUSTRIAL APPLICABILITY OF THE INVENTION

The present invention is related generally to roof coverings such as roofing shingles, and more particularly to backdust materials for roof coverings.

BACKGROUND OF THE INVENTION

It is known to apply a fine particulate material, known as a "backdust", on the back surface of roof coverings such as roofing shingles or roll roofing. The backdust prevents the roofing shingles from sticking together when they are stacked in a bundle, and it prevents the roll roofing from sticking together in a roll. The backdust is typically made from rock, which may be crushed as in talc, carbonate or rock dust. The backdust may also be produced by screening sediment, such as silica sand backdust.

U.S. Pat. No. 5,964,911 to Morano et al. discloses a process for making glass particles by forming a glass melt from furnace dust and silica, quenching the glass melt, and crushing and sieving the quenched glass. The glass particles are said to be useful as roofing granules. However, there is no suggestion to use the glass particles as backdust on a roof covering, and no indication that the glass particles would be suitable for use as backdust.

Canadian Patent No. 2,284,071 to Harada discloses a method for producing glass particles in which glass articles are crushed to convert them into fine glass fragments, then the finely crushed glass fragments are agitated to eliminate sharp portions and form particles, and then the glass particles are sieved to remove foreign materials and sort the particles according to size. There is no suggestion to use the glass particles as backdust or as roofing granules on a roof covering.

It would be advantageous to provide a new backdust material having desirable properties and providing benefits to the environment.

SUMMARY OF THE INVENTION

The above objects as well as others not specifically enumerated are achieved by a roof covering according to the invention having a plurality of glass particles applied as a backdust on the back surface.

The invention also relates to a method of manufacturing a roof covering. A substrate is coated with an organic-based coating material. Then, a plurality of glass particles are applied as a backdust on the back surface of the coated substrate.

The invention also relates to a method of manufacturing asphalt roofing shingles. Glass particles are crushed and then classified by size. The glass particles which are large in size are applied as roofing granules on the roofing shingles. The glass particles which are medium in size are applied as backdust on the roofing shingles. The glass particles which are fines are used as a filler in the asphalt coating of the roofing shingles.

Various objects and advantages of this invention will become apparent to those skilled in the art from the following detailed description of the preferred embodiments, when read in light of the accompanying drawings.

DETAILED DESCRIPTION AND PREFERRED EMBODIMENTS OF THE INVENTION

Figure 1:
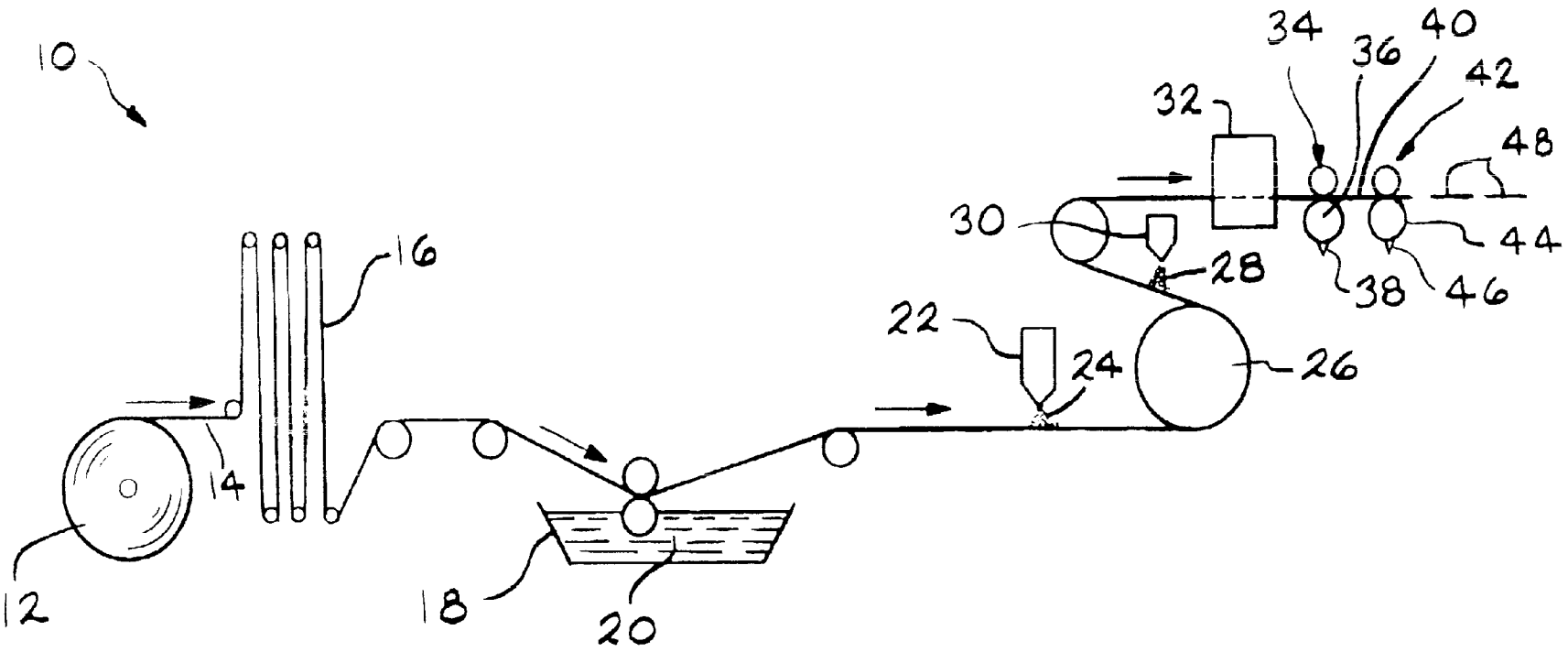
FIG. 1 is a schematic elevational view of apparatus for manufacturing roofing shingles including a glass particle backdust according to the invention.

Referring now to the drawings, there is shown in FIG. 1 an example of apparatus 10 for manufacturing roofing shingles including a glass particle backdust according to the invention. Although the invention will be illustrated in relation to three-tab roofing shingles, it is to be understood that the invention is also applicable to other types of roof coverings, such as laminated roofing shingles, roll roofing, or built-up roofing.

Initially, a substrate is payed out from a roll 12 as a continuous sheet 14. The substrate can be any type of material known for use in reinforcing roofing shingles, such as a web, scrim or felt of fibrous materials such as mineral fibers, cellulose fibers, rag fibers, mixtures of mineral and synthetic fibers, or the like. Preferably, the substrate is a nonwoven web of glass fibers.

The sheet is passed from the roll through an accumulator 16. The accumulator allows time for splicing one roll of mat to another, during which time the mat within the accumulator is fed to the manufacturing process so that the splicing does not interrupt manufacturing.

Next, the sheet is passed through a coater 18 where an organic-based coating material 20 is applied to the sheet. The coating material can be applied in any suitable manner. In the illustrated embodiment, the sheet is submerged in a supply of hot, molten coating material to completely cover the sheet with the tacky coating material. However, in other embodiments, the coating material can be sprayed on, rolled on, or applied to the sheet by other means.

The term "organic-based coating material" means a coating material containing a substantial quantity of an organic material such as a bituminous material and/or a polymeric material. Any type of bituminous material suitable for coating roof coverings can be used, such as asphalt, tar, pitch, or a mixture thereof. The asphalt can be either a manufactured asphalt produced by refining petroleum or by other methods, or a naturally occurring asphalt. The coating material can also include various additives and/or modifiers, such as inorganic fillers or mineral stabilizers. In a typical asphalt roofing shingle, the coating material includes asphalt and a filler of finely ground inorganic particulate matter, such as ground limestone, in an amount within a range of from about 40% to about 80% by weight of the coating material. The filler may include crushed glass fines (e.g., less than 325 mesh [0.044 mm]), preferably in a small percentage in combination with another filler material such as ground limestone.

The hot coated sheet is passed beneath a series of granule applicators 22 (one of which is shown) that discharge protective roofing granules 24 onto the top surface of the sheet. A preferred granule applicator is a granule blender of the type disclosed in U.S. Pat. No. 5,599,581 to Burton et al. In the manufacture of colored shingles, two types of roofing granules are typically employed. Headlap roofing granules are granules of relatively low cost used for the portion of the shingle that will be covered on the roof. These headlap granules may be of crushed glass particles having a diameter within a range between about 0.2 mm and about 2 mm. Colored roofing granules or prime roofing granules are of relatively higher cost and are applied to the portion of the shingle that will be exposed on the roof. The crushed glass particles may be coated and used as colored roofing granules.

The sheet is passed around a drum 26 that presses the roofing granules into the hot, tacky coating material and inverts the sheet sufficiently for any non-adhering roofing granules to fall into a hopper (not shown) for recycling. While the sheet is inverted, a glass particle backdust 28 according to the invention is applied to the back surface of the sheet. The backdust is supplied from a backdust applicator 30. The glass particle backdust will be described in more detail below.

Next, the sheet is passed through a cooling section 32 in which the coating material is cooled. Any suitable type of cooling section can be used. In a typical cooling section, the sheet is passed up and down between a number of rolls and sprayed with water to cool the coating material.

The sheet is fed through a rotary pattern cutter 34 which includes a cutting cylinder 36 having a cutting knife 38 or blade. The pattern cutter cuts the sheet into multiple continuous strips 40 of shingles (one of which is shown), and cuts a series of cutouts and notches in each of the strips. Next, each of the strips 40 is fed through a length cutter 42 which includes a cutting cylinder 44 having a cutting knife 46. The length cutter cuts the strip into a plurality of roofing shingles 48. Finally, the roofing shingles are stacked in bundles and packaged using suitable equipment (not shown).

Figure 2:
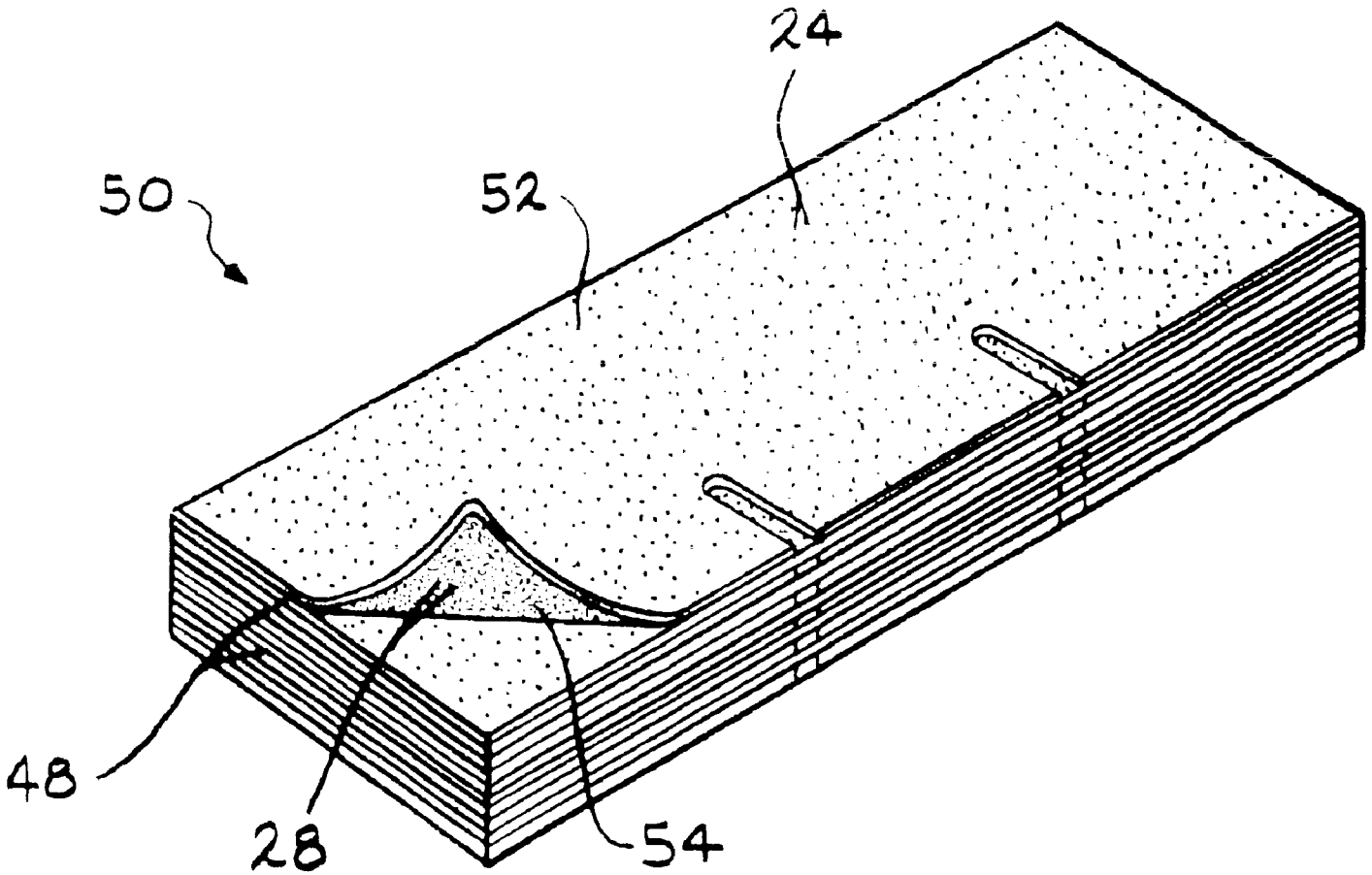
FIG. 2 is a perspective view of a bundle of roofing shingles having a glass particle backdust applied to the back surface of the shingles according to the invention.

FIG. 2 illustrates a bundle 50 of the roofing shingles 48. As shown in the drawing, a plurality of roofing granules 24 are adhered to the top surface 52 of the roofing shingle (the surface exposed when the shingle is installed on a roof). A plurality of glass particles 28 are applied as a backdust on the back surface 54 of the roofing shingle (the surface facing the roof when the shingle is installed on the roof). The backdust prevents the roofing shingles from sticking together in the bundle.

It has now been found that glass particles can advantageously be used as a backdust material on roof coverings. In a preferred embodiment, the glass particles are suitable for use in a roof covering manufacturing process in direct substitution for existing backdust materials. This saves the expense of modifying the equipment and/or process to accommodate the new backdust material.

Preferably, the glass particles are particles of recycled post-consumer waste glass such as glass containers, light bulbs, plate glass, and automotive glass. The use of recycled glass reduces environmental problems caused by the disposal of such glass. The recycled glass is also low in cost. The recycled glass particles are not visible when used as a backdust material, and therefore the glass particles do not have to be sorted by type/color, eliminating a significant cost and limitation to the recycling of waste glass. The presence of some contaminants in the glass particles is acceptable, so long as the contaminants are not harmful to the roof covering manufacturing process or incompatible with the asphalt. The use of glass particles as a backdust material is safe because glass dust is classified as not more than a nuisance dust.

In one embodiment, the invention relates to a method of manufacturing asphalt roofing shingles in which the glass particles are crushed and then classified by size. The glass particles which are large in size (e.g., retained on a 30 mesh screen [0.59 mm openings]) are applied as roofing granules on the roofing shingles. The glass particles which are medium in size (e.g., pass through a 30 mesh screen [0.59 mm openings] but retained on a 325 mesh screen [0.044 mm openings]) are applied as backdust on the roofing shingles. The glass particles which are fines (e.g., pass through a 325 mesh screen [0.044 mm openings]) are used as a filler in the asphalt coating of the roofing shingles.

Figure 3:
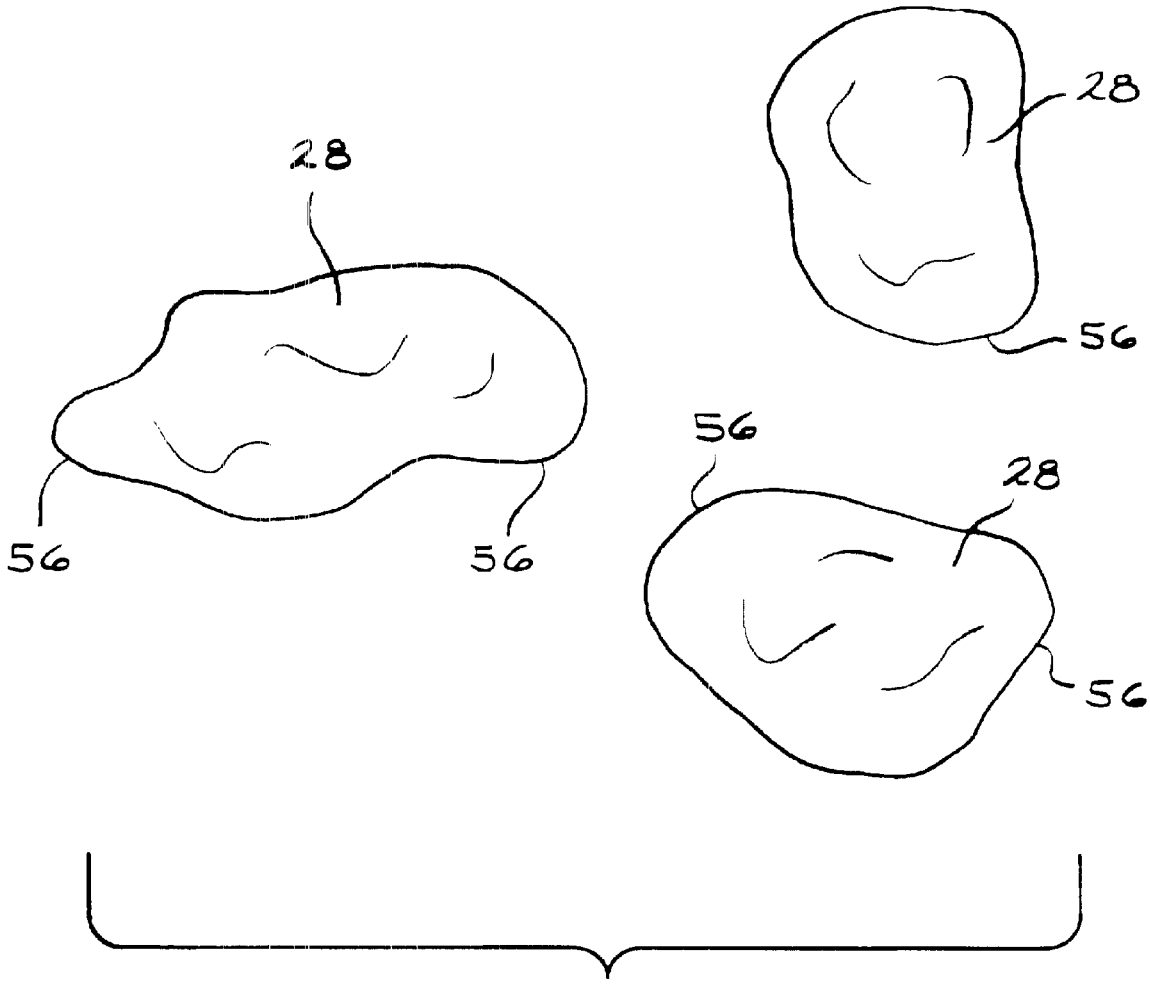
FIG. 3 is an enlarged schematic view of several glass particles suitable for use as roofing backdust according to the invention.

FIG. 3 illustrates several glass particles 28 which are suitable for use as a roofing backdust according to the invention. Preferably, the glass particles are substantially rounded to subangular in shape. The term "subangular" means that the particles are somewhat angular but free from sharp edges and corners. Where the sides of the glass particle meet, the intersections are rounded instead of being sharp. As shown in FIG. 3, the glass particles have rounded or curved outer surface portions 56 instead of sharp edges or corners. The glass particles do not have a rough feel. Conventional glass particles have sharp edges, are excessively angular, and feel rough to the touch.

The rounded to subangular shape of the glass particles provides advantages over conventional glass particles. One advantage is that the glass particles have lower abrasive qualities. The preferred glass particles are less abrasive than silica sand particles which are sometimes used as a backdust material. The lower abrasiveness is due to the shape of the particles as well as the lower hardness of glass (Mohs hardness of 5.5) compared to silica (Mohs hardness of 7). Advantageously, the lower abrasive qualities reduce wear on the cutting knives used to cut the roofing shingles compared to the amount of wear on the same cutting knives when the shingles have the same amount of silica sand backdust. Another advantage is that the glass particles with the rounded to subangular shape have good handleability, such that the glass particles can be handled with the bare hands without substantial injury to the hands.

Preferably, the glass particles have good flowability, such that they are substantially free-flowing when subjected to pressure or gravity. The good flowability allows the glass particles to function well as a backdust material, and to be easily incorporated into a roof covering manufacturing process.

Preferably, the glass particles have a bulk density within a range between about 55 $lb/ft^3$ (881 $kg/m^3$) and about 75 $lb/ft^3$ (1202 $kg/m^3$).

The glass particles can have any particle size suitable for use as a backdust material on a roof covering. Typically, the glass particles have a particle size similar to fine-grained silica sand, the particles having an average diameter between about 0.04 mm and about 0.3 mm. Preferably, the glass particles have a particle size such that not more than about 5% by weight of the granules are retained on a 30 mesh screen (0.59 mm openings) and not more than about 5% by weight of the granules pass through a 270 mesh screen (0.053 mm openings) (U.S. Standard Sieve Size).

The glass particles can be manufactured by any suitable method to achieve the desired particle properties. A preferred method is by the use of a Three-Compartment Flexible Rotor Adjustable Impact Grinder, Model No. MFR1824000, manufactured by Minpro International Ltd., 1055 Pachino Court, Burlington, Ontario L7L6B9, CANADA. Beginning with recycled waste glass, the grinder throws the glass into successive grinding compartments, and it causes the glass to continuously spin. Repeated impacts of the glass break up the glass into particles and form rounded edges on the particles. While the Minpro grinder is a preferred type of equipment for manufacturing the glass particles, it is understood that the particles can also be manufactured using other types of equipment.

Figure 4:
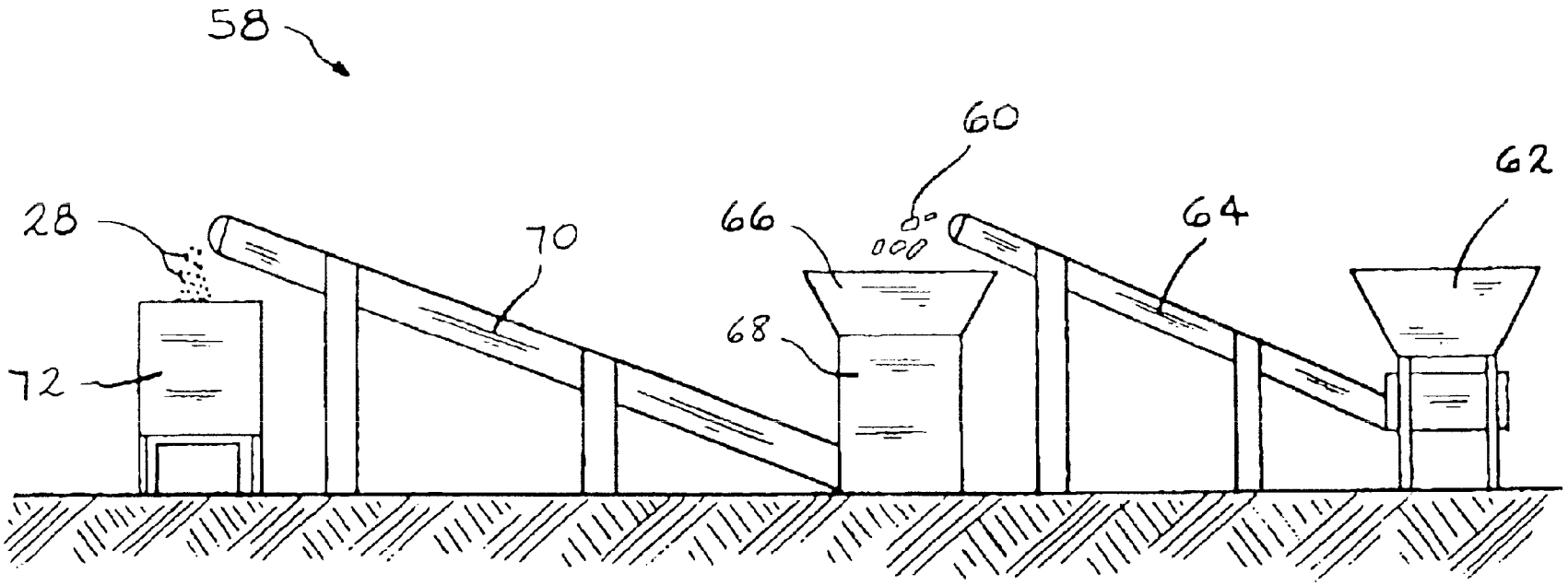
FIG. 4 is a schematic elevational view of apparatus for manufacturing glass particles for use as roofing backdust according to the invention.

FIG. 4 illustrates an apparatus 58 suitable for manufacturing glass particles for use as roofing backdust according to the invention. Recycled waste glass 60 is fed into a hopper 62. The waste glass 60 is moved on a conveyor 64 and dropped into a hopper 66 of a crushing machine 68. The crushing machine converts the waste glass into glass particles, and forms the particles to have a rounded to subangular shape. The glass particles 28 are fed on a conveyor 70 into the top of a sieve stack 72. The sieve stack produces the desired particle size distribution by screening the glass particles through a series of screens of different mesh sizes.

The principle and mode of operation of this invention have been described in its preferred embodiments. However, it should be noted that this invention may be practiced otherwise than as specifically illustrated and described without departing from its scope. For example, while the invention has been described primarily in terms of a glass backdust material for three-tab roofing shingles, the invention is also applicable to other types of roof coverings. While a preferred method has been described for manufacturing the glass particles, the particles can also be manufactured by other methods producing particles having the desired properties.

What is claimed is:

1. A roof covering having a back surface and having a plurality of glass particles applied as a backdust on the back surface.

2. A roof covering according to claim 1 wherein the glass particles are substantially rounded to subangular in shape.

3. A roof covering according to claim 1 wherein the glass particles are less abrasive than silica sand particles.

4. A roof covering according to claim 3 wherein the glass particles applied to roofing shingles cause a reduction in the wear of a cutting knife used to cut the roofing shingles, compared to the amount of wear on the same cutting knife cutting the same roofing shingles having the same amount of silica sand particles applied as a backdust.

5. A roof covering according to claim 1 wherein the glass particles can be handled with bare hands without substantial injury to the hands.

6. A roof covering according to claim 1 wherein the glass particles are particles of recycled glass.

7. A roof covering according to claim 1 wherein the glass particles are flowable.

8. A roof covering according to claim 1 wherein the glass particles have a particle size distribution such that not more than 5% by weight of the granules are retained on a 30 mesh screen and not more than 5% by weight of the granules pass through a 270 mesh screen.

9. A roof covering according to claim 1 wherein the glass particles have a bulk density within a range between about 55 lb/ft$^3$ (881 kg/m$^3$) and about 75 lb/ft$^3$ (1202 kg/m$^3$).

10. A roof covering according to claim 1 wherein the glass particles are substantially rounded to subangular in shape, are less abrasive than silica sand particles, and are flowable.

11. A roof covering according to claim 10 wherein the glass particles are particles of recycled glass.

12. A roof covering according to claim 10 wherein the glass particles have a particle size distribution such that not more than 5% by weight of the granules are retained on a 30 mesh screen and not more than 5% by weight of the granules pass through a 270 mesh screen.

13. A roof covering according to claim 10 wherein the glass particles have a bulk density within a range between about 55 lb/ft$^3$ (881 kg/m$^3$) and about 75 lb/ft$^3$ (1202 kg/m$^3$).

14. A roof covering according to claim 10 wherein the glass particles are particles of recycled glass, the glass particles have a particle size distribution such that not more than 5% by weight of the granules are retained on a 30 mesh screen and not more than 5% by weight of the granules pass through a 270 mesh screen, and the glass particles have a bulk density within a range between about 55 lb/ft$^3$ (881 kg/m$^3$) and about 75 lb/ft$^3$ (1202 kg/m$^3$).

15. A method of manufacturing a roof covering comprising:

coating a substrate with an organic-based coating material, the coated substrate having a back surface; and applying a plurality of glass particles as a backdust on the back surface.

16. A method according to claim 15 wherein the glass particles are produced by crushing recycled glass and then classifying the particles to a predetermined size.

17. A method according to claim 15 wherein the glass particles are substantially rounded to subangular in shape.

18. A method according to claim 15 wherein the glass particles are less abrasive than silica sand particles.

19. A method according to claim 15 which comprises manufacturing roofing shingles, and wherein the glass particles applied to the roofing shingles cause a reduction in the wear of cutting knives of a shingle machine used to cut the roofing shingles, compared to the same amount of silica sand particles applied to the same roofing shingles and cut with the same machine.

20. A method of manufacturing asphalt roofing shingles comprising:

a) crushing glass particles;

b) classifying the glass particles by size;

c) applying the glass particles which are large in size as roofing granules on the roofing shingles;

c) applying the glass particles which are medium in size as backdust on the roofing shingles; and e) using the glass particles which are fines as a filler in an asphalt coating of the roofing shingles.

* * * * *